US008485110B2

(12) United States Patent
Gaydos et al.

(10) Patent No.: US 8,485,110 B2
(45) Date of Patent: Jul. 16, 2013

(54) APPARATUS FOR CONTROLLING DISCHARGE OF MATERIAL FROM A RAILROAD HOPPER CAR

(75) Inventors: Christopher C. Gaydos, Hampshire, IL (US); Guadalupe L. Galvan, DeKalb, IL (US); Steve R. White, Maple Park, IL (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 218 days.

(21) Appl. No.: 12/932,107

(22) Filed: Feb. 17, 2011

(65) Prior Publication Data

US 2012/0210906 A1 Aug. 23, 2012

(51) Int. Cl.
*B61D 3/00* (2006.01)

(52) U.S. Cl.
USPC ..... 105/247; 105/286

(58) Field of Classification Search
USPC ..... 105/247, 286, 306, 308.1, 311.1
See application file for complete search history.

(56) References Cited

U.S. PATENT DOCUMENTS 6,227,124 B1 * 5/2001 Gaydos et al. ..... 105/286
6,279,487 B1 8/2001 Gaydos et al.
6,431,084 B1 8/2002 Gaydos
6,604,469 B1 8/2003 Galvan et al.
6,637,346 B2 10/2003 Gaydos

OTHER PUBLICATIONS

Miner Enterprises, Inc.; Enterprise Ore Cars; Enterprise 50 Years 1905-1955; 2009; Title page along with pp. 24-25; Chicago, IL.; USA.

* cited by examiner

*Primary Examiner* — R. J. McCarry, Jr.
(74) *Attorney, Agent, or Firm* — Law Office of John W. Harbst

(57) ABSTRACT

An apparatus for controlling the discharge of materials from a railcar having a hopper carried on a mobile frame. The hopper defines a longitudinally disposed discharge opening. The railcar has a door pivotally mounted for movement between an open position and a closed position relative to the discharge opening. The apparatus for controlling the discharge of materials from the railcar includes an operating shaft and a drive operably coupled between the door and the operating shaft for causing the door to move from the closed position toward the open position in response to rotation of the operating shaft. The drive also includes a lost motion connection for protecting the operating shaft as the door freely pivots toward the open position during collapsing movement of the lost motion connection and after the operating shaft has been rotated a predetermined amount to open the door.

31 Claims, 12 Drawing Sheets

APPARATUS FOR CONTROLLING DISCHARGE OF MATERIAL FROM A RAILROAD HOPPER CAR

FIELD OF THE INVENTION DISCLOSURE

This invention disclosure generally relates to railroad hopper cars and, more specifically, to an apparatus for controlling discharge of material from a railroad hopper car.

BACKGROUND OF THE INVENTION DISCLOSURE

One type of railroad freight car in use today is an open-top hopper car wherein an elongated walled enclosure or hopper holds material there within. The hopper is mounted on a mobile frame or undercarriage and defines a longitudinal axis for the car. Such railcars are used to transport aggregate, iron ore, coal and other materials and offer an advantageous economical method of transporting large amounts of materials between distant locations.

The granular commodities or materials can be rapidly discharged from the hopper through a discharge opening defined by the hopper. In many open-top railroad hopper cars, one or more doors are pivotally mounted or hinged along an upper edge to the hopper for vertical swinging movement between closed and open positions relative to the discharge opening. When closed, the doors prevent discharge of materials from the hopper. When released from their closed position, the doors gravitationally swing toward an open position assisted by the material moving through the discharge opening.

As will be appreciated, different door operating devices have been proposed to releasably maintain the doors in their closed position. It is important to note, however, such door operating devices are specifically designed to the particular application with which they will find use. For example, a device used to operate longitudinally mounted swinging doors on a railroad hopper car cannot, without substantial modifications and redesign, be used to operate transversely mounted doors on a railroad hopper car. Conversely, and primarily because of the disposition of the doors on the railroad hopper car, known devices used to operate transversely mounted swinging doors on a railroad hopper car cannot, without substantial modifications and redesign, be used to operate longitudinally mounted swinging doors on a railroad hopper car.

Designing an apparatus used to control operation of the doors of an open-top railroad hopper car used to transport ore, coal and like materials, is complicated by the relatively heavy weight of the materials. That is, the weight of the materials carried in the railcar hopper impart a significant columnar load to the doors in the closed position. Moreover, and once the doors are released from their closed position, the gravitationally falling material tends to force the doors open with significant force. As such, the mechanism used to control operation of the doors must have sufficient strength and rigidity to perform under conditions wherein significant loads and forces are imparted thereto during all phases of door operation.

Once a hopper car reaches an unloading site, the doors on the hopper are swung open and gravity normally causes the material within the hopper to flow therefrom. As mentioned, however, the materials within the hopper exert a relatively large columnar load on the doors. Such downward load on the door has caused and continues to cause a significant problem in manual opening of the doors at the unloading site. Of course, at the unloading site time is of the essence and any complications involving opening of the doors to unload the material from the hopper prevents serious concerns.

In some applications, mechanized openers are used to operate the railroad hopper car doors. These mechanically driven openers include a rotatably driven member which must be aligned with and engage a free end of an operating shaft forming part of the door operating mechanism. As such, and unless the opener is timely removed from engagement with the operating shaft of the door operating mechanism, and as the doors swing to their open position, the significant loads acting on the doors by the gravitationally falling materials moving through the discharge opening can be transferred to the driven member of the opener. Besides the problems involved with properly aligning the driven member of the opener to the operating shaft of the door operating mechanism, these transferred loads can and often do result in significant damage to the opener. Moreover, and as the railcar moves along the rails during the unloading process, the mechanically driven opener is dragged along therewith, thus, imparting other loads and forces to the apparatus used to control operation of the doors.

Because some railcar hoppers are of an open-top design, the material in the hopper car is continually exposed to the environment and weather conditions. In cold weather environments, the particulate material in the open-top hopper frequently freezes together thus hindering their discharge from the railcar hopper. Such conditions often require workers at the discharge sites to strike the sides of the railcar hopper with large hammers in an effort to loosen the frozen materials and create a flow of material through the discharge opening. As will be appreciated, and besides the adverse time consuming affects resulting from such needed manual efforts, striking the hopper with a large hammer can also result in significant damage to the railcar.

Thus, there is a need and continuing desire for an apparatus for controlling the positive discharge of materials from a railroad car having an open-top hopper notwithstanding the environment while facilitating use of and offering protection to a driven opener used to open the doors of a railroad hopper car.

SUMMARY

In view of the above, and in accordance with one aspect, there is provided an apparatus for controlling the discharge of materials from a railcar having a wheeled frame defining a longitudinal axis for the car and a hopper carried on the frame. The hopper defines a longitudinally disposed discharge opening. The railcar has a door mounted to the hopper for pivotal movement between an open position and a closed position relative to the discharge opening. The apparatus for controlling the discharge of materials from the railcar includes an rotatable operating shaft and a drive operably coupled between the door and the operating shaft for causing the door to move from the closed position toward the open position in response to rotation of the operating shaft. The drive also includes a lost motion connection for allowing the door to freely pivot toward the open position during collapsing movement of the lost motion connection and after the operating shaft has been rotated a predetermined amount to open the door. The lost motion connection protects the operating shaft against the gravitational effects the materials have acting on the door as the door moves toward the open position.

Preferably, the apparatus for controlling the discharge of materials from the railcar further includes a bumper for cushioning impacts of the free falling door against the frame when the door freely pivots toward the open position. In one form, the bumper is formed from elastomeric material.

In one embodiment, the drive for operating the door has a linkage assembly including first and second interconnected links positioned relative to each other, when the door is in the closed position, in an overcenter relationship whereby allowing the links to act as a primary lock for releasably maintaining the door in the closed position while preventing the door from inadvertently moving toward the open position. The drive furthermore preferably includes a gear box for transferring rotating movement of the operating shaft to the linkage system. The gear box preferably includes a worm gear rotatable with the operating shaft and a driven gear arranged in operable combination with the worm gear. The worm gear and driven gear serve as a secondary lock for releasably maintaining the door in the closed position.

In one form, the lost motion connection includes a slotted drive member which permits the drive to freely move through a predetermined range of movement and relative to the operating shaft before the door begins to move toward the open position. Preferably, the slotted drive member of the lost motion connection includes radially spaced pin engaging surfaces. In one form, the lost motion connection further includes a pin arranged for movement between the pin engaging surfaces of the slotted drive member for reconnecting the operating shaft with the drive upon the collapse of the rotary lost motion connection. In one form, the pin associated with the lost motion connection is preferably configured as a shear pin so as to advantageously offer protection to each drive against an overload of torque being applied thereto.

According to another aspect, there is provided an apparatus for controlling discharge of materials from a railcar having a wheeled frame defining a longitudinal axis for the car and a hopper carried on the frame. The hopper defines a longitudinally disposed discharge opening. The railcar has a door mounted to the hopper for pivotal movement between an open position and a closed position relative to the discharge opening. The apparatus for controlling discharge of materials from a railcar includes an operating shaft carried by the car for rotation about a fixed axis and a drive operably coupled between the door and the operating shaft for causing the door to move from the closed position toward the open position in response to rotation of the input shaft. The drive includes a driven shaft carried by the car in generally normal relation relative to the operating shaft. The driven shaft is operably coupled to the operating shaft such that when the operating shaft is rotated the driven shaft rotates therewith. The drive further includes a lost motion connection between the door and the operating shaft for isolating the operating shaft during collapsing movement of the lost motion connection from the gravitational forces of material acting on the door as the door moves toward the open position.

Preferably, the drive includes a shear key operably disposed between the operating shaft and the door for inhibiting damage to the drive during operation of the door. In one form, a bumper is provided for cushioning impacts of the door against the frame when the door freely pivots toward the open position. The bumper preferably includes elastomeric material.

In one form, the drive has a linkage assembly including first and second interconnected links positioned relative to each other, when the door is in the closed position, in an overcenter relationship whereby allowing the links to act as a primary lock for releasably maintaining the door in the closed position while preventing the door from inadvertently moving toward the open position. Preferably, the drive further includes a gear box for transferring rotating movement of the operating shaft to the linkage assembly. In one form, the gear box includes a worm gear rotatable with the operating shaft and a driven gear arranged in operable combination with the worm gear. The worm gear and the driven gear serve as a secondary lock for releasably maintaining the door in the closed position.

The lost motion connection furthermore preferably includes a slotted drive member which permits the drive to freely move through a predetermined range of movement before the door begins to move toward the open position. In one form, the slotted drive member of the rotary lost motion connection includes radially spaced pin engagement surfaces. In one embodiment, the lost motion connection further includes a pin carried by the driven shaft and arranged for movement between the pin engagement surfaces for reestablishing the connection between the operating shaft and drive upon the collapse of the rotary lost motion connection.

According to another aspect, there is provided an apparatus for controlling discharge of materials from a railcar having a wheeled frame defining a longitudinal axis for the car and a hopper carried on the frame. The hopper defines a longitudinally disposed discharge opening. The railcar has two doors mounted to the hopper for pivotal movement between an open position and a closed position relative to the discharge opening. A first door is mounted to one lateral side of the longitudinal axis of the car while a second door is mounted to an opposed lateral side of the longitudinal axis of the car. The control apparatus includes an elongated operating shaft carried by the car for rotation about a fixed axis and which moves the first and second doors simultaneously from the closed position toward an open position. Opposed ends of the operating shaft are accessible from opposed sides of the car. First and second drives are operably coupled between the first and second doors and the operating shaft for causing the doors to move from the closed position toward the open position in response to rotation of the operating shaft in a first rotational direction. Each drive includes a lost motion connection for allowing the respective door to freely pivot toward the open position during collapsing movement of the lost motion connection and after the operating shaft has been rotated a predetermined amount to open the doors. The lost motion connection of each drive isolates the operating shaft during collapsing movement of the lost motion connection against the gravitational forces of material acting on the doors as the doors move from the closed position toward the open position.

In a preferred form, both the first drive and the second drive include a shear member operably disposed between the operating shaft and the first and second doors for inhibiting damage to either drive during operation of the doors. Moreover, each drive preferably includes a bumper for cushioning impacts of the first and second doors against the frame when the doors freely pivot toward their open position. In one form, each bumper includes elastomeric material.

Preferably, the first drive and the second drive each include a linkage assembly including first and second interconnected links positioned relative to each other, when the respective door is in the closed position, in an overcenter relationship whereby allowing the links to act as a primary lock for releasably maintaining the respective door in the closed position while preventing the respective door from inadvertently moving toward the open position.

Additionally, each drive preferably includes a gear box for transferring rotary movement of the operating shaft to the linkage assembly of the respective drive. In a preferred form, the gear box of each drive includes a worm gear rotatable with the operating shaft and a driven gear arranged in operable combination with the worm gear. The worm gear and driven gear serve as a secondary lock for releasably maintaining the respective door in the closed position.

In one embodiment, the lost motion connection of each drive includes a slotted drive member which permits the drive to freely move through a predetermined range of movement relative to the operating shaft after the respective doors move toward the open position. In one form, the slotted drive member of the rotary lost motion connection includes radially spaced pin engaging surfaces. In one embodiment, the lost motion connection further includes a pin carried by the driven shaft and arranged for movement between the pin engaging surfaces for reestablishing the connection between the operating shaft and drive upon the collapse of the rotary lost motion connection. Moreover, each drive preferably includes a mechanical indicator for visually indicating the position of the respective door relative to the closed position.

DETAILED DESCRIPTION OF THE DRAWINGS

DETAILED DESCRIPTION OF THE INVENTION DISCLOSURE

Figure 1:
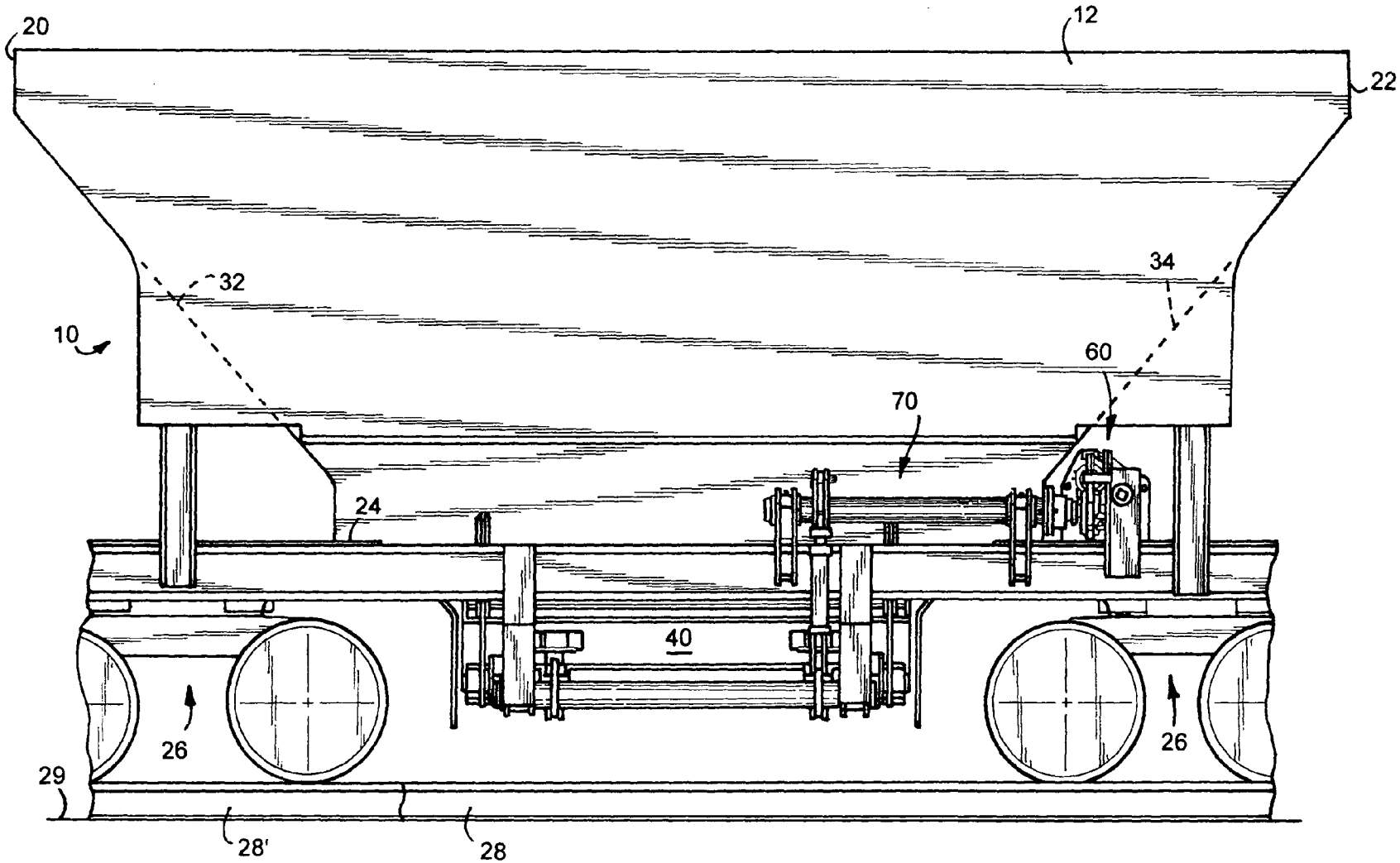
FIG. 1 is a side elevational view of a railroad hopper car embodying principals and teachings of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Referring now to the drawings, wherein like reference numerals indicate like parts throughout the several views, there is shown in FIG. 1 a railroad hopper car, generally designated by reference numeral 10. Car 10 includes a hopper 12 wherein materials are stored and transported and defines a longitudinal axis 14 (FIG. 2) for the car 10. Hopper 12 includes upstanding side walls 16 and 18 (FIG. 2) rigidly joined by opposed end walls 20 and 22. As shown in FIG. 1, hopper 12 is carried by a mobile frame 24 of car 10. Opposed ends of the hopper 12 and frame 24 are supported in a well known manner by trucks 26 shown pictorially in FIG. 1. As shown in FIGS. 1 and 3, wheels of each truck engage a pair of laterally spaced rails 28 and 28' on a track bed 29.

Figure 2:
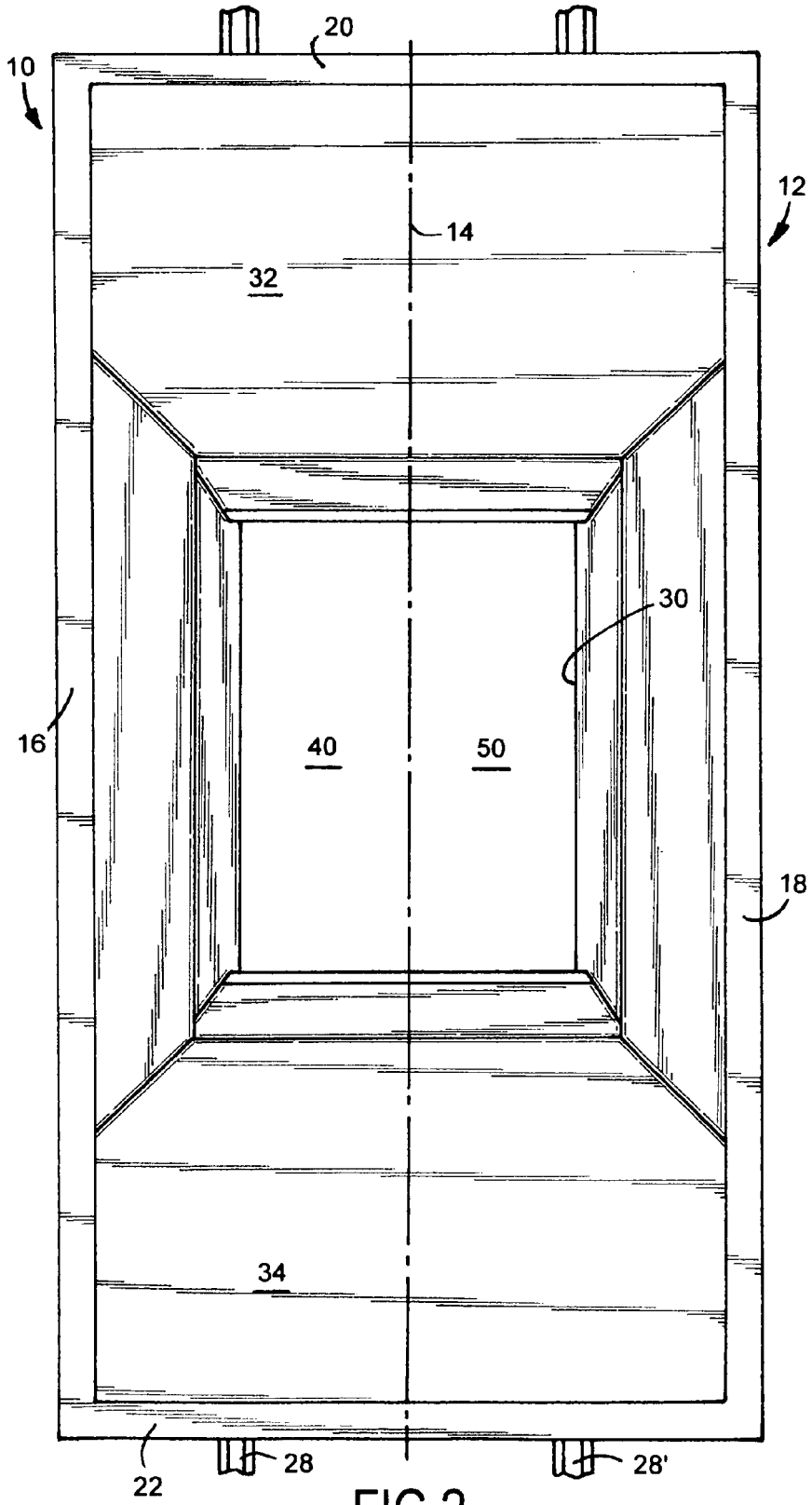
FIG. 2 is a top plan view of the railroad hopper car illustrated in FIG. 1.
Figure 3:
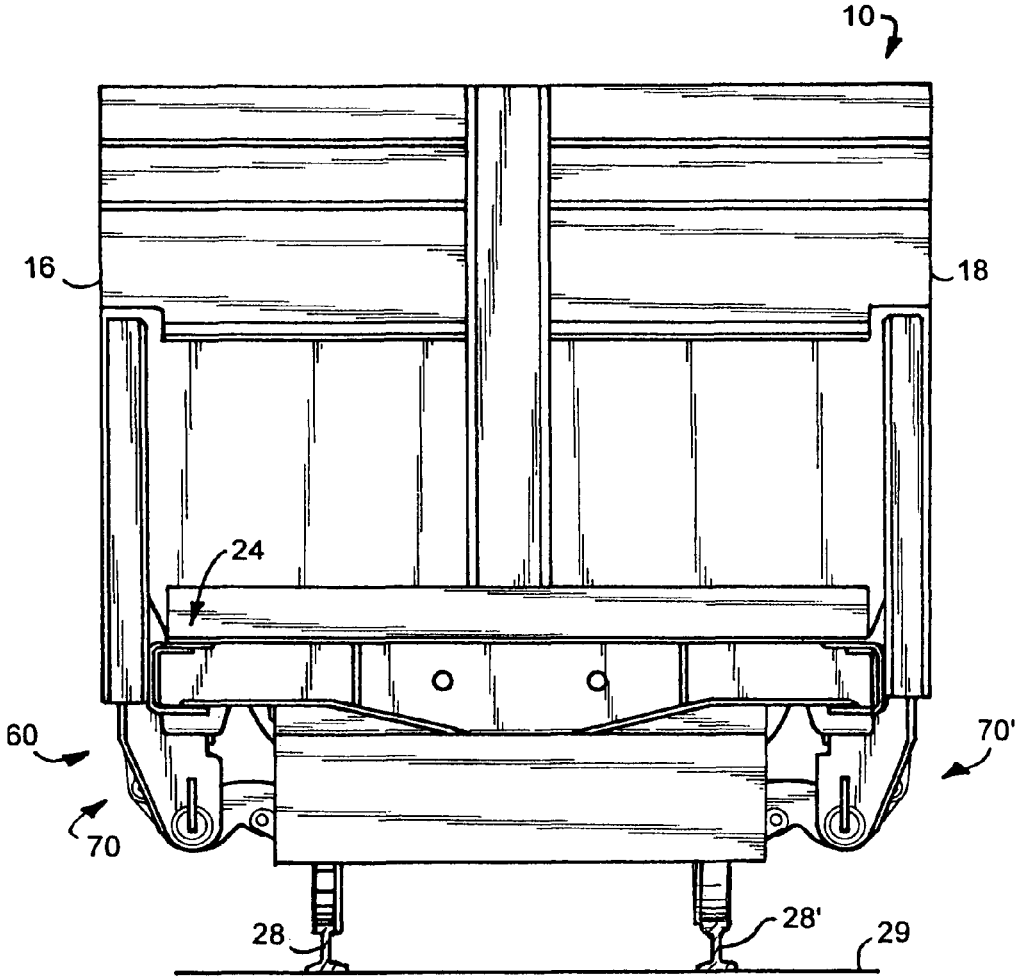
FIG. 3 is an end view of the railroad hopper car illustrated in FIG. 1.

In the embodiment illustrated in FIG. 2, hopper 12 defines a centrally disposed and longitudinally disposed and elongated discharge opening 30 from whence materials in the hopper 12 can be gravitationally discharged. To facilitate gravity unloading of the contents or materials from car 10, hopper 12 is preferably formed in part with a plurality of angled sheets 32 and 34 which slope downward and terminate toward the opening 30.

The flow or discharge of material from hopper 12 through discharge opening 30 is controlled by first and second longitudinally elongated doors 40 and 50 mounted to the hopper 12 for pivotal movements between a closed position (FIG. 4) and an open position (FIG. 5) and relative to the discharge opening 30. Door 40 is mounted to one lateral side of the longitudinal axis 14 of car 10 while door 50 is mounted to an opposed lateral side of the longitudinal axis 14 of car 10. Preferably, each door 40, 50 is pivotally mounted toward their upper edge to the hopper 12 such that the doors 40, 50 tend to naturally swing toward an open position. A lower longitudinal and flanged edge 42, 52 of each respective door 40, 50 is preferably configured to move into abutting relationship relative to the opposed door when the doors are moved into their closed relationship relative to each other and relative to opening 30.

Figure 6:
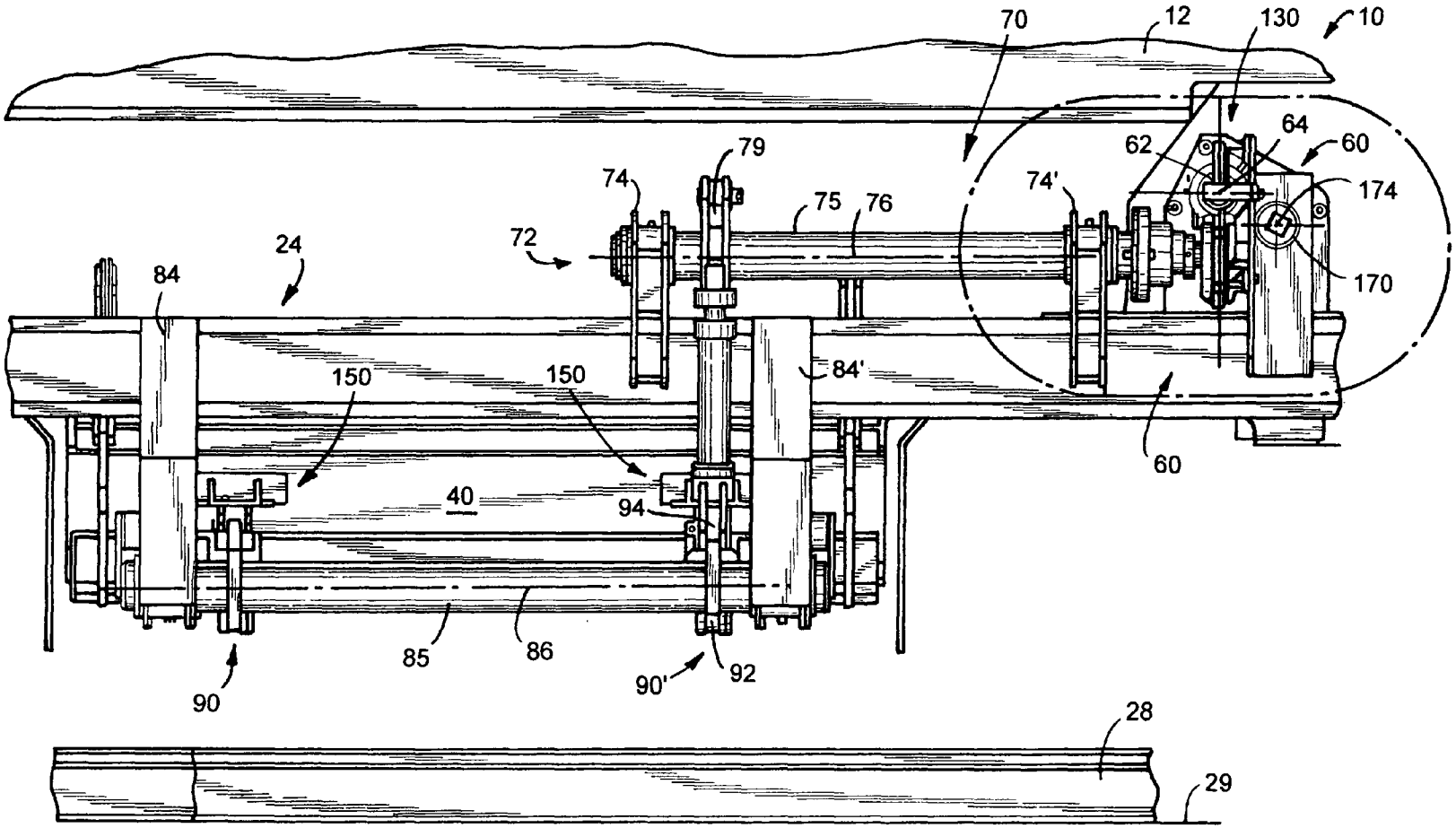
FIG. 6 is an enlarged elevational view of one form of a drive forming part of the present invention disclosure.
Figure 7:
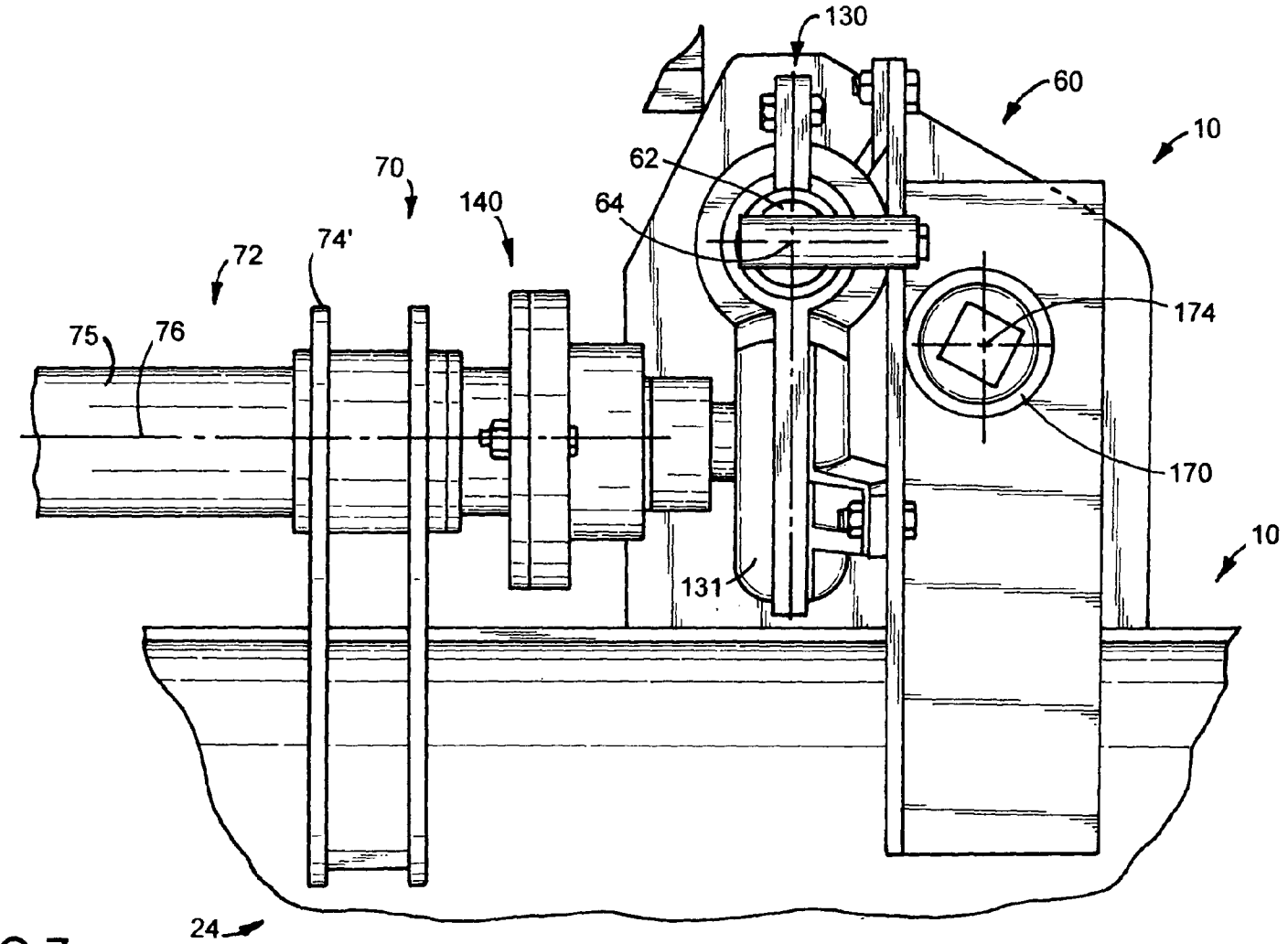
FIG. 7 is an enlarged elevational view of that area surrounded in phantom lines in FIG. 6.

Operation of the doors 40, 50 is controlled by an apparatus generally designated in FIGS. 1 and 6 by reference numeral 60. As shown in FIGS. 6 and 7, apparatus 60 includes an operating shaft 62 carried by car 10 for rotation about a fixed axis 64. Preferably, the operating shaft 62 has an elongated configuration and extends generally transverse or normal to the longitudinal axis 14 of car 10. Moreover, in a preferred embodiment, the control apparatus 60 is configured such that rotation of shaft 62 causes simultaneous movement of both doors 40 and 50. That is, apparatus 60 is preferably configured such that rotation of shaft 62 in a first direction results in simultaneous movement of both doors 40, 50 from the closed position toward the open position. Moreover, apparatus 60 is preferably configured such that rotation of shaft 62 in a second direction, opposite from the first direction, results in simultaneous movement of both doors 40, 50 from the open position toward the closed position.

Figure 4:
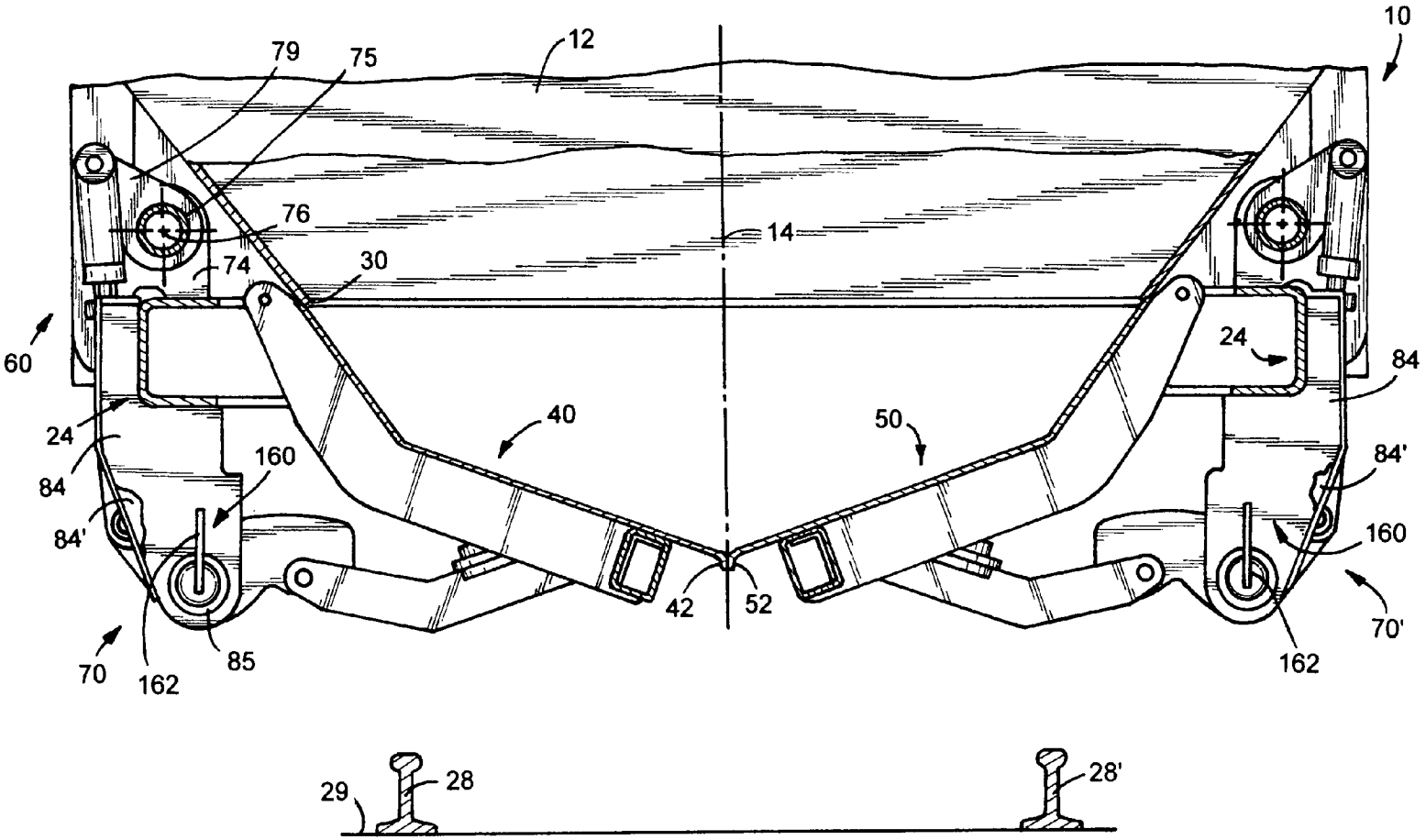
FIG. 4 is an enlarged transverse sectional view showing longitudinally arranged doors on the hopper car in a closed position relative to a discharge opening.

Because there are two doors 40 and 50 associated with hopper 12, and as shown in FIG. 4, apparatus 60 preferably includes a first drive 70 for operating door 40 and a second drive 70' for operating door 50. To reduce manufacturing costs, the drives 70 and 70' are substantially similar relative to each other. Accordingly, only drive 70 will be described in detail.

Each drive 70 and 70' preferably and advantageously serves identical and multiple purposes. That is, each drive is operably coupled between the respective door and the operating shaft 62 for controlling movement of the respective door between the closed position and the open position in response to rotation of the operating shaft 62 in a first direction about axis 64. Each drive furthermore preferably serves to maintain and releasably hold the respective door in the closed position. Moreover, each drive is preferably configured to provide a visual indication of the position of the respective door relative to the discharge opening 30.

Figure 8:
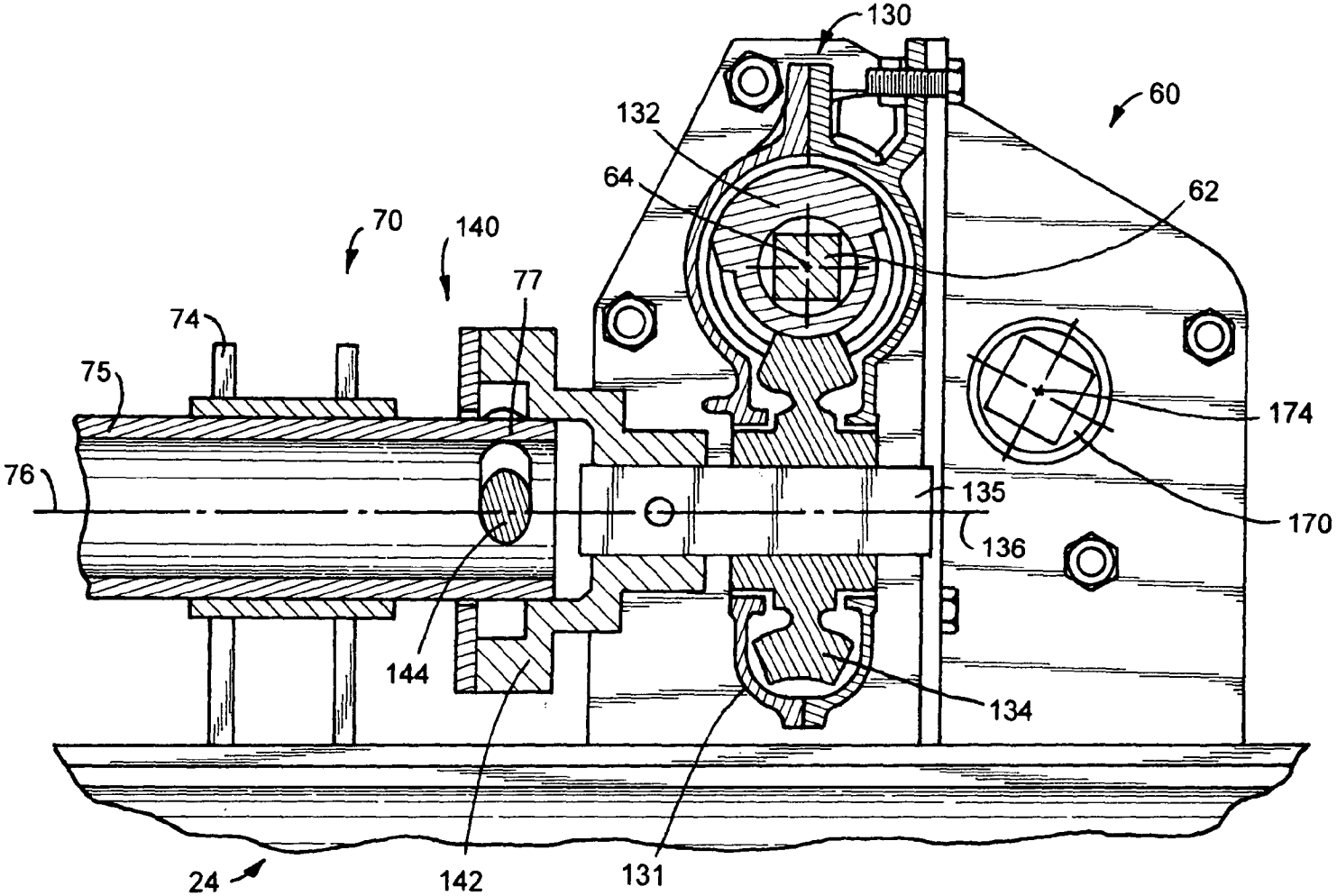
FIG. 8 is a longitudinal sectional view of that shown in FIG. 7.

In the form shown by way of example in FIG. 6, each drive includes a linkage system 72 having multiple links for transferring rotary movement from the operating shaft 62 to the respective door. As shown in FIG. 6, a pair of longitudinally spaced vertically disposed supports 74 and 74' are secured to or and carried by and extend upwardly from frame 24 of car 10. The supports 74 and 74' journal a longitudinally elongated shaft 75 for rotation about an axis 76 extending generally parallel to the longitudinal axis 14 of car 10 (FIG. 2). Advantageously, shaft 75 preferably has a tubular configuration to reduce the weight thereof while maintaining the strength and rigidity thereof. It should be noted, however, shaft 75 is permitted to rotate about axis 76 while inhibiting endwise or axial shifting movement of shaft 75. As shown in FIG. 8, shaft 75 extends longitudinally beyond the support 74' and terminates in a free end 77. In the embodiment of the drive 70 shown in FIGS. 4, 5 and 6, shaft 76 is provided with a driver 79, preferably configured as a lever arm, which radially extends away from axis 76 of and is non-rotatably secured or connected to shaft 75.

As shown in FIG. 6, another pair of longitudinally spaced and vertically disposed supports 84 and 84' are secured to or and carried by and depend from frame 24 of car 10. Supports 84 and 84' journal a longitudinally elongated shaft 85 for rotation about an axis 86 extending generally parallel to axis 76 of shaft 75. Like shaft 75, shaft 85 is permitted to rotate about axis 86 while being inhibited from endwise or axial shifting movement relative to the supports 84, 84'. Like shaft 75, shaft 85 preferably has a tubular configuration to reduce the weight thereof while advantageously maintaining the strength and rigidity thereof.

As shown in FIG. 6, each drive for moving the respective door between closed and open positions furthermore includes a pair of linkage assemblies 90 and 90' extending between shaft 85 and the respective door on car 10. The linkage assemblies 90 and 90' operate and are preferably designed substantially identical relative to each other. Accordingly, only linkage assembly 90' will be described in detail.

Figure 9:
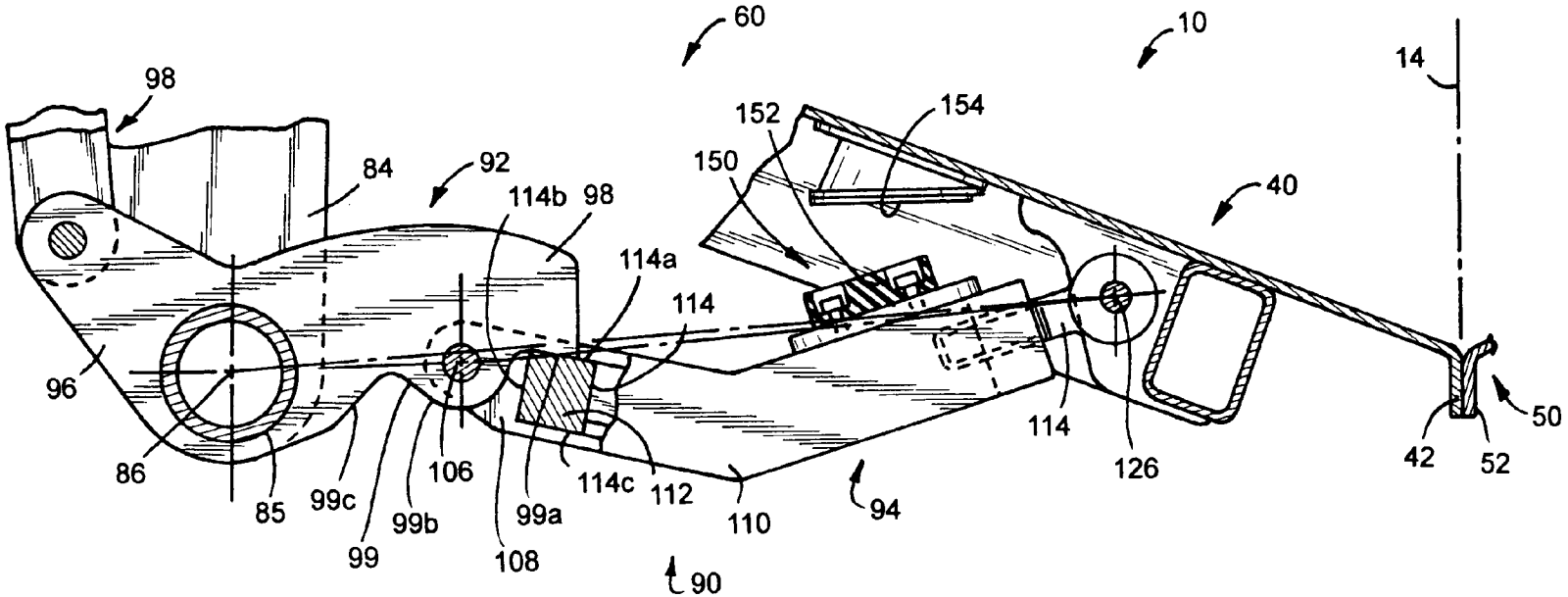
FIG. 9 is an enlarged view showing one form of a linkage assembly used to move one hopper car door between closed and open positions.

Turning now to FIG. 9, each linkage assembly preferably includes a pair of articulately interconnected links 92 and 94 between shaft 85 and the respective door. At least one linkage assembly is preferably designed such that link 92 is configured as a bell crank lever secured in non-rotatable relation to and with shaft 85. In the illustrated embodiment, the links 92 and 94 preferably operate under compression to push the respective door toward the closed position and to pull the respective door toward the open position.

Figure 10:
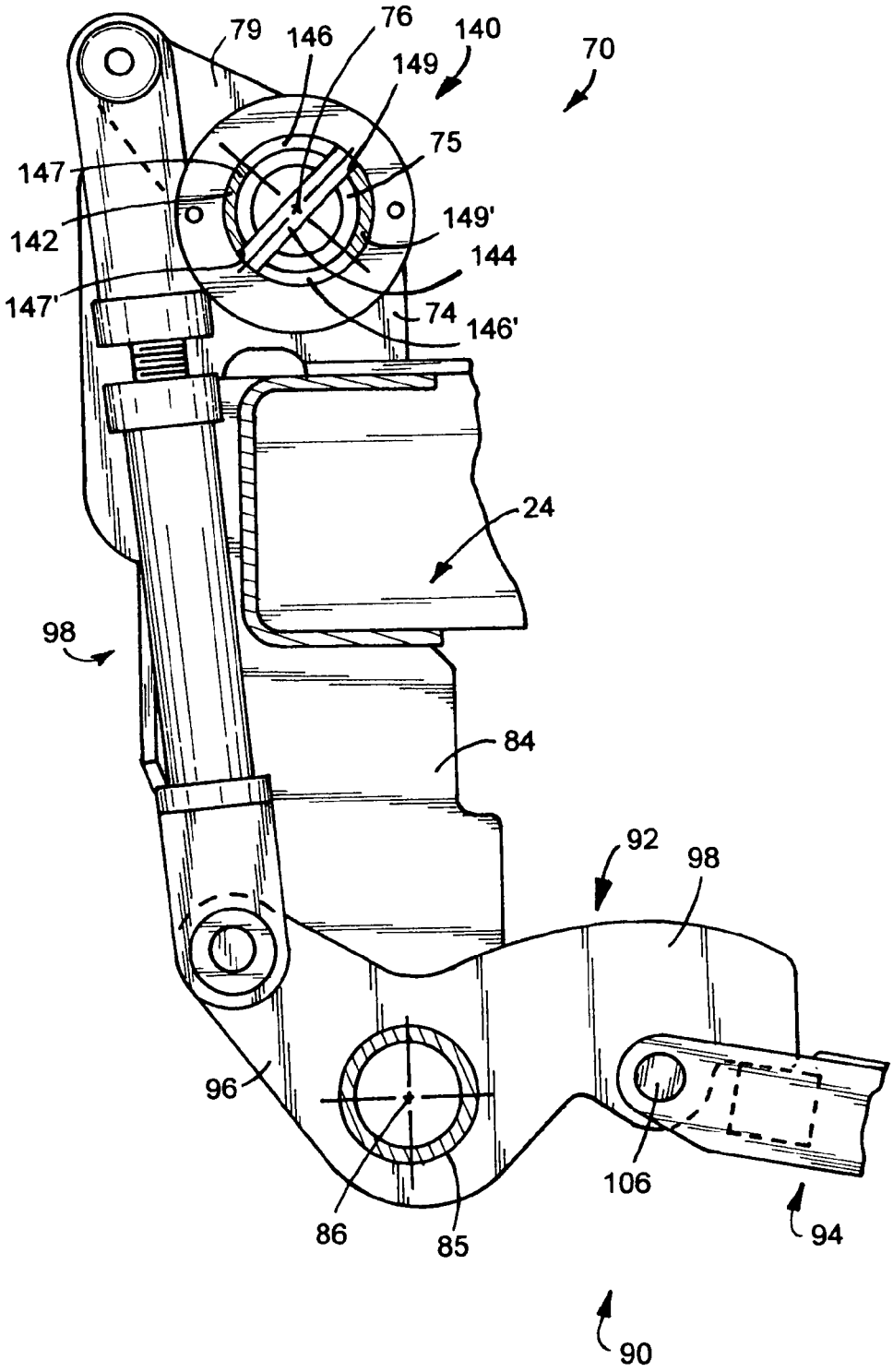
FIG. 10 is another enlarged view showing one form of drive for operating the linkage assembly shown in FIG. 9.

In the form shown in FIG. 9, link 92 includes a pair of arms 96 and 98 extending in opposed radial directions from axis 86 of shaft 85. Notably, and in that embodiment shown in FIG. 6, arm 96 of link 92 is arranged in generally vertical alignment with driver arm 79 extending radially from shaft 75. Toward a free end thereof, and in radially spaced relation from axis 86 of shaft 85, arm 96 of link 92 is articulately joined to a connector 98 which operably interconnects arm 96 of link 92 with driver 79. As shown in FIG. 10, connector 98 is articulately joined to driver 79 at a location disposed in radially spaced relation from axis 76 of shaft 75. Preferably, connector 98 is designed intermediate its opposed ends to allow for adjustment of the operable length thereof.

As shown in FIGS. 9 and 10, the other arm 98 of lever or link 92 is articulately joined to one end of an elongated link 98 at a location 106 arranged in radially spaced relation from axis 86 of shaft 85. The opposed end of link 96 is articulately connected, as at location 126, to the respective door (FIG. 9).

In the embodiment illustrated by way of example in FIG. 9, link 94 includes a pair of spaced apart elongated lever arms 108 and 110 which preferably embrace arm 98 of link 94 therebetween. As further shown in FIG. 9, and toward the location 106 whereat arm 98 of link 92 and link 94 are articulately interconnected, link 94 further includes a brace or spacer 112 which is securely fastened to the lever arms 108 and 110. At its opposite end, lever 94 os provided with a connector 114 which facilitates pivotal connection of the levers arms 108 and 110 of link 94 to the respective door. Preferably, connector 114 and link 98 are designed such that the operable length of link 94 can be adjusted to optimize the abutting relationship between the abutting longitudinal edges 42, 52 when the doors 40, 50, respectively, are moved to their closed position relative to each other and relative to the discharge opening 30.

As shown in FIG. 9, and for purposes described in detail below, that portion of link 92 embraced between the lever arms 108 and 110 of link 94 preferably has a peripheral face 99 significant portions of which are identified as 99*a*, 99*b* and 99*c*. Similarly, and for purposes described in detail below, the brace or spacer 112 also preferably has an outer surface 114 significant portions of which are identified as 114*a*, 114*b* and 114*c*.

In a preferred embodiment, each linkage assembly 90 and 90' is preferably designed as an overcenter linkage mechanism and acts as a primary lock for the respective door operated thereby. That is, when the respective door is in a closed position, the location 106 where at arm 98 of link 92 is articulately interconnected to link 94, along with the location 126 of the articulate connection of link 94 relative to the respective door 40 and relative to axis 86 of shaft 85 are such that an overcenter relationship or design is preferably established when the respective door is in the closed position. Preferably, when door 40 is in the closed position, the location 106 of the connection between arm 98 of link 92 and link 94 assumes an overcenter position relative to the axis 86 of shaft 85 and the location whereat link 94 is connected to the respective door 40 to positively maintain the respective door in the closed position. As such, the location 106 of the connection between arm 98 of link 92 and link 94 is required to move overcenter when the door is to be moved from the closed position toward the open position. Preferably designing each drive 70, 70' with such overcenter capability allows the linkage assembly 90, 90' of each drive 70, 70' to operably serve as a primary lock for releasably maintaining the respective doors 40, 50 in their closed position.

In the embodiment illustrated by way of example in FIG. 9, and when the door is in the closed position, the abutting relationship between surface portion 99*a* of link 92 and the surface portion 114*a* on link 94 prevents shaft 85 from rotating about axis 96. With the surface portion 99*a* of link 92 and the surface portion 114*a* on link 94 being in abutting relationship, the links 92 and 94 of each linkage assembly 90, 90' (FIG. 6) have assumed an overcenter relationship relative to each other whereby releasably maintaining the respective door in the closed position.

Each drive 70, 70' of the control apparatus 60 further includes a gear box 130 fixedly mounted on frame 24 of car 10 and which receives rotational input from operating shaft 62. Amongst other features, the gear box 131 serves as a torque multiplier between operating shaft 62 and shaft 75. In the embodiment illustrated by way of example in FIG. 8, gear box 130 includes a housing 131 containing a rotatable drive gear 132, secured for rotation with shaft 62, and a driven gear or wheel 134 arranged in intermeshing relation and operable combination with drive gear 132. The driven gear or wheel 134 of gear box 130 is secured to a shaft 135 journaled for rotation by gear box housing 132 and having a fixed rotational axis 136 disposed in generally coaxial relation relative to shaft 75. As will be appreciated from the above description, when rotation is imparted to operating shaft 62, gear box 130 redirects and transfers rotary motion from the operating shaft 62 to shaft 135 which rotates about axis 136 and is disposed in generally perpendicular or generally normal relationship relative to operating shaft 62.

In a preferred embodiment, drive gear 132 is configured as a worm gear. To open the door with which gear box 130 is associated requires worm gear 132 to be driven in one rotational direction. Notably, the forces acting on the respective door cannot drive the worm gear in reverse—in a direction opposed to that direction for opening the door. As such, and in combination with the intermeshing relationship with driven wheel 134, gear box 130 is permitted to act as a secondary lock for releasably maintaining each door 40, 50 in the closed position while preventing the door from inadvertently moving toward the open position.

Figure 5:
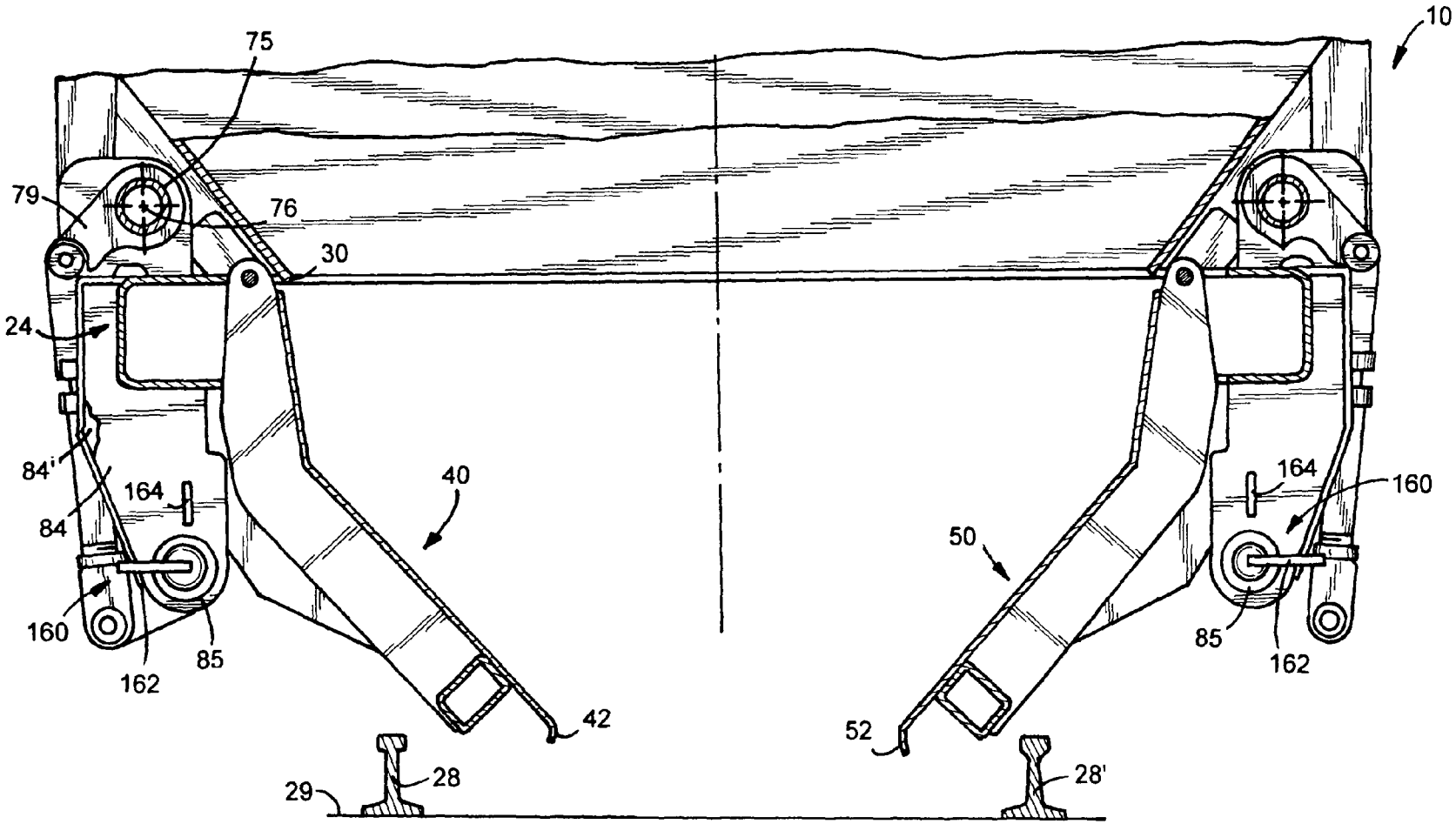
FIG. 5 is an enlarged transverse sectional view similar to FIG. 4 showing the doors on the hopper car in an open position relative to a discharge opening.

Once the doors 40 and 50 are released from the their locked and closed position (FIG. 4), each drive 70 and 70' of the control apparatus 60 is preferably configured and designed to limit the forces acting on the operating shaft 62 as a result of the gravitational effects the materials being discharged from the hopper 12 have acting on the doors 40, 50 as the door moves toward their open position relative to the discharge opening (FIG. 5). Moreover, and once the doors 40 and 50 are released from the their locked and closed position (FIG. 4), each drive 70 and 70' of the control apparatus 60 is preferably configured to isolate the operating shaft 62 from the gravitational forces of materials being discharged from hopper 12 and acting on the doors 40 and 50 as the doors move toward their open position (FIG. 5). Also, and once the doors 40 and 50 are released from the their locked and closed position (FIG. 4), each drive 70 and 70' of the control apparatus 60 is preferably configured to allow the doors 40, 50 to freely fall toward their open position and impact with the railroad car frame 24 so as to impart vibration forces to the hopper 12 whereby facilitating the discharge of materials through opening 30.

To achieve such advantageous ends, each drive 70. 70' of control apparatus 60 includes a lost motion connection 140 operably disposed between the doors 40, 50 and the operating shaft 62 for allowing a predetermined range of free movement of each drive 70, 70' once the doors 40, 50 begin their movement toward the open position. In the embodiment illustrated in FIG. 8, the lost motion connection 140 preferably includes, in operable combination relative to each other, a slip socket or sleeve 142 arranged toward that end of shaft 135 disposed away from the gear box 130 and a pin 144 carried by the free end of and extending generally normal to shaft 75. In one form, pin 144 is designed as a shear pin for protecting each individual drive 70, 70' against excessive torque being applied thereto.

Figure 11:
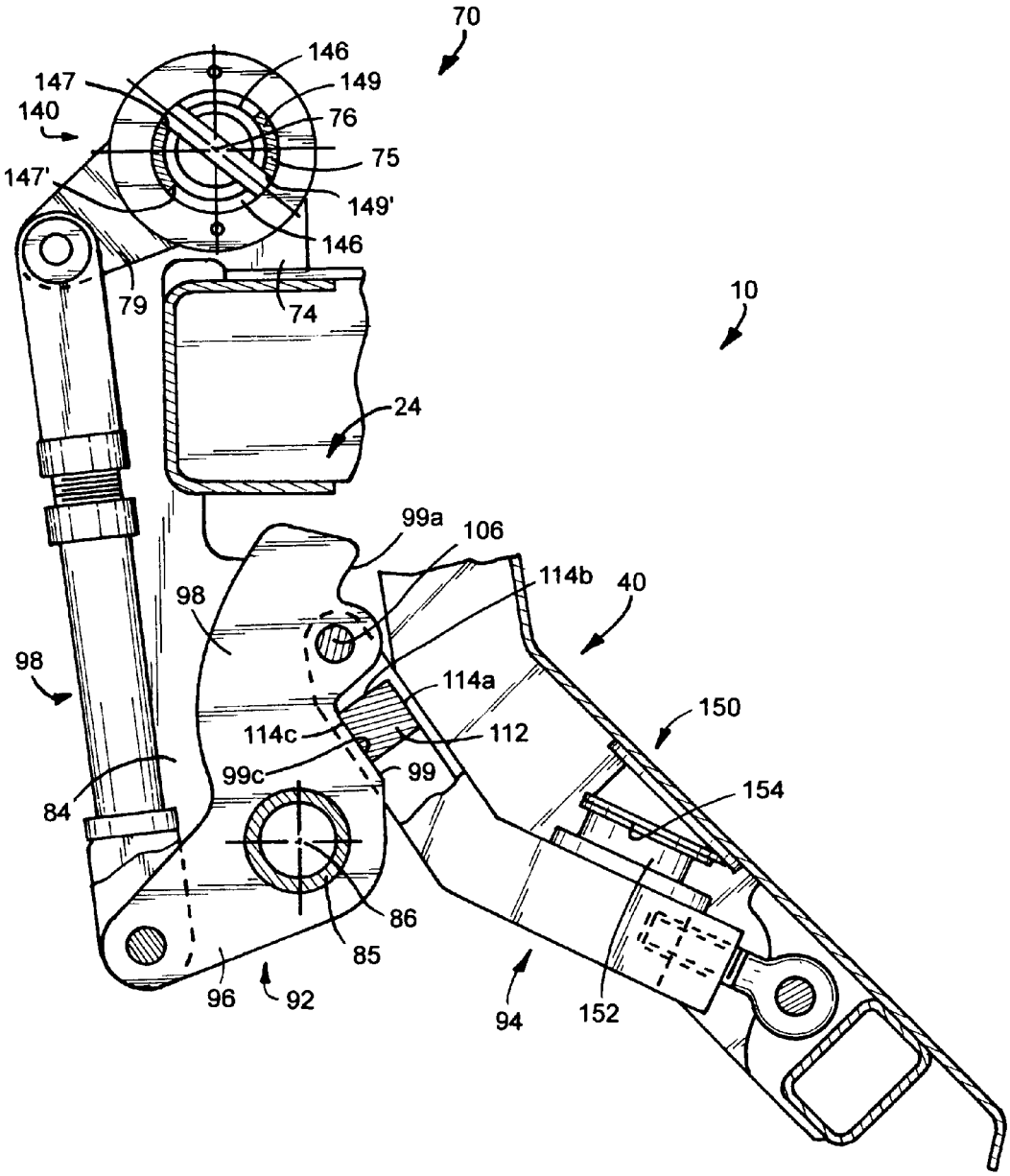
FIG. 11 is a view similar to FIG. 10 showing the drive being used to move one hopper car door to an open position.

As shown in FIGS. 10 and 11, opposed ends of pin 144 extend through a pair of circumferential slots 146 and 146' provided on opposite sides of the sleeve 142 at the end of shaft 135. Slot 146 defines radially spaced pin engagement surfaces 147 and 149 toward opposed ends thereof. Similarly, slot 146 defines radially spaced pin engagement surfaces 147' and 149' toward opposed ends thereof. The radial spacing between the pin engagement surfaces 147 and 149 is substantially equal to the radial spacing between the pin engagement surfaces 147' and 149'. Preferably, the radial distance between the pin engagement surfaces 147 and 149 is sufficient to allow between about 60° and about 100° of relative free rotation between shaft 75 and shaft 135 as pin 144 translates between the pin engagement surfaces 147 and 149. In a most preferred embodiment, the radial distance between the pin engagement surfaces 147 and 149 is sufficient to allow between about 90° of relative free rotation between shaft 75 and shaft 135 as pin 144 translates between the pin engagement surfaces 147 and 149. In the illustrated embodiment, a cover 148 is furthermore carried by the sleeve 142 to prevent inadvertent release or endwise movement of the pin 144 away from the circumferential slots 146, 146'. Notably, the cover 148 rotates with the slip socket or sleeve 142 and relative to shaft 75.

When the doors are in their releasably closed position, the drive pin 144 of each lost motion connection 140 is in the position illustrated by way of example in FIG. 10 and toward one end of its travel against the pin engagement surfaces 147' and 149 within the circumferential slots 146 and 146'. To open the doors 40, 50, rotation is imparted to the operating shaft 62. Rotation of shaft 62 causes drive gear 132 to rotate the driven gear 134 and turn shaft 135 about axis 136 whereby rotating the sleeve 142 of the lost motion connection 140 in a counterclockwise direction as shown in FIG. 10.

As the sleeve 142 of the lost motion connection 140 is rotated in a counterclockwise direction as shown in FIG. 10, the drive, pin 144 also rotates therewith as a result of its engagement with the pin engagement surfaces 149 and 147' whereby rotating shaft 75 about axis 76 and in a counterclockwise direction as seen in FIG. 10. In the illustrated embodiment, and as a result of the counterclockwise rotation of shaft 75 about axis 76 the drive arm or lever 79 of each drive is also forcibly caused to rotate in a counterclockwise direction as shown in FIG. 10. The rotational movement of driver 79 is transferred to link 92 through connector 98 whereby causing link 92 to rotate in a counterclockwise direction as shown in FIG. 10.

In a preferred form, link 92 is required to rotate in a counterclockwise direction as shown in FIG. 10 and through a range of travel whereby overcoming the overcenter locking arrangement for linkage assemblies 90 and 90' before the respective door can move toward the open position (FIG. 5). In one form, the shaft 75 and link 92 move in a counterclockwise direction as shown in FIG. 10 and preferably through a range of travel between about 10° and about 20° before the overcenter locking arrangement of linkage assemblies 90 and 90' is overcome. In a most preferred embodiment, shaft 75 and link 92 move in a counterclockwise direction as shown in FIG. 10 and preferably through a range of travel of about 16° before the overcenter locking arrangement of linkage assemblies 90 and 90' is overcome.

Once the overcenter locking arrangement of linkages 90 and 90' is overcome, the drive pin 144 freely moves or traverses from the position shown in FIG. 10 to the position shown in FIG. 11 so as to collapse the lost motion connection 140 which, in turn, permits free rotation of shaft 75 about axis 76. Preferably, and upon collapse of the lost motion connection 140, the drive pin 144 freely moves through the slots 139 and is not limited by the pin engagement surfaces 147 and 149'. During the collapse of the lost motion connection 140, driver 79 moves from the position illustrated in FIG. 10 to the position illustrated in FIG. 11 and through connector 98 causes link 92 of the linkage assemblies 90 and 90' to be forcibly driven to the position illustrated in FIG. 11 from the position shown in FIG. 10.

Because the drive pin 144 is permitted to freely move or traverse through the circumferential slots 149 and 149' during collapse of the lost motion connection 140, shaft 75 freely moves relative to the operating shaft 62 whereby substantially removing the forces which would otherwise be imparted to the operating shaft 62 as a result of the gravitational effects the materials being discharged from the hopper 12 have acting on the doors 40, 50 as the door moves toward their open position relative to the discharge opening (FIG. 5). In operation, and once the doors 40 and 50 are released from the their locked and closed position (FIG. 4), the lost motion connection 140 preferably isolates the operating shaft 62 from the gravitational forces of materials being discharge from hopper 12 and acting on the doors 40 and 50 as the doors move toward their open position (FIG. 5).

In the preferred embodiment, movement of link 92 in a counterclockwise direction as shown in FIG. 11 is abruptly halted by the abutting relationship of the surface 114*c* on spacer 114 carried by link 94 with confronting surface 99*c* on link 92. The abutting relationship between surface 114*c* on spacer 114 carried by link 94 with confronting surface 98*c* on link 92 coupled with the speed of the free falling door imparts a significant vibrational force to the frame 24 and hopper 12 of car 10. The import of such vibrational forces to frame 24 and hopper 12 facilitates the discharge of frozen or clustered material through the discharge opening 30 and from hopper 12 during unloading of the car 10.

In a preferred form, and because of the relatively high level of impact the freely falling doors 40 import to the hopper 12 and frame 24, at least one cushioning apparatus 150 (FIG. 6) is provided for dampening or cushioning the impacts the free falling doors 40, 50 have on car 10 during an unloading operation. In the embodiment illustrated by way of example in FIG. 9, the cushioning apparatus 150 can include a pad or cushion 152 preferably formed from an elastomeric material which, in the illustrated embodiment, is carried by and movable with link 94 of linkage 90. An impact member 154 is arranged in the respective door for use in combination with the pad or cushion 152. As shown in FIG. 11, and just before the door reaches the open position, the pad or cushion 152 and member 154 are brought into operable combination relative to each other whereby dampening or cushioning the impacts the free falling doors 40, 50 have on car 10 during an unloading operation. Moreover, the cushioning apparatus 150 serves to advantageously reduce forces acting against the pin 126 (FIG. 9) used to articulately interconnect link 94 to the respective door.

Returning to FIG. 4, each drive 70, 70' further includes a mechanical indicator 160 for visually indicating the position of the respective door relative to a closed position. The indicator 160 can take any of a myriad of different designs without detracting or departing from the true spirt and scope of this invention disclosure. Preferably, the indicator 160 associated with linkage 70 is identical to the indicator associated with linkage 70'.

In the embodiment illustrated in FIG. 4, indicator 160 includes a pointer or free ended element 162 disposed at the free end of shaft 85 longitudinally outward from the support 84'. In the embodiment illustrated, indicator 160 further includes a marker 164 (FIG. 5) preferably carried on an outer surface of support 84'. When the respective door is in a closed position, the pointer or free ended element 162 generally aligns with the marker 164 whereby providing a visual indication the respective door is in the closed position. When the respective door is moved from the closed position, shaft 85 rotates less than 360 degrees. As such, and when the respective door is moved toward an open position, shaft 85 rotates and carries therewith the pointer or element 162 away or out of general alignment with the marker 164. Accordingly, the indicator 160 will provide a clear visual image the respective door is in other than a closed position relative to the discharge opening 30 on hopper 12.

To return the doors 40, 50 toward and into a closed position (FIG. 4), rotation is imparted to the operating shaft 62 in a direction opposed to that used to open the doors. Rotation of shaft 62 in a direction to close the doors 40, 50 causes drive gear 132 to rotate the driven gear 134 and turn shaft 135 about axis 136 whereby rotating the sleeve 142 of the lost motion connection 140 in a clockwise direction as shown in FIG. 11.

As the sleeve 142 of the lost motion connection 140 is rotated in a clockwise direction as shown in FIG. 11, the drive pin 144 also rotates therewith as a result of its engagement with the pin engagement surfaces 147 and 149' whereby rotating shaft 75 about axis 76 and in a clockwise direction as seen in FIG. 11. In the illustrated embodiment, and as a result of the clockwise rotation of shaft 75 about axis 76 (as seen in FIG. 11) the drive arm or lever 79 of each drive is also forcibly caused to rotate in a clockwise direction as shown in FIG. 11. The rotational movement of driver 79 is transferred to link 92 through connector 98 whereby causing link 92 to also rotate in a clockwise direction as shown in FIG. 11.

In a preferred form, rotation of link 92 in a clockwise direction as shown in FIG. 11 pushes the link 94 toward a position shown in FIG. 9. Rotation of link 92 in a clockwise direction shown in FIG. 11 continues until surface 99*a* on link 92 again abuts against surface 114*a* on spacer 114 of link 94 and the respective door is in the closed position (FIG. 9). In this position, sleeve 142 of the lost motion connection 140 is rotated to the position shown in FIG. 10 with the links 92 and 92 arranged in an overcenter and locked position (FIG. 9) to releasably maintain the doors 40, 50 in the closed position.

Returning to FIGS. 6, 7 and 8, in a preferred embodiment, each drive of control apparatus 60 furthermore includes an input shaft 170 mounted toward opposed sides 16 and 18 (FIG. 2) of car 10 for inputting rotation, from either side of car 10, to the control apparatus 60. Input shaft 170 is preferably mounted for rotation about a fixed axis 174 and, in the illustrated embodiment, is arranged in vertically spaced and generally parallel relation relative to operating shaft 62. A free end of input shaft 170, disposed closest to the respective side 16, 18 (FIG. 2) of hopper 10, is preferably configured to be operably coupled to a drive spindle of a conventional driver (not shown) typically used at an unloading site to operate the hopper car doors 40, 50 between their closed and open positions (FIGS. 4 and 5).

Providing an input shaft 170 as part of each drive 70 and 70' serves a number of advantageous ends. First, providing shaft 170 as part of each drive 70 and 70' and part of control apparatus 60 standardizes the location and size of the operating shaft 62 relative to current railroad hopper cars. Second, providing shaft 170 as part of each drive 70 and 70' and as part of control apparatus 60 advantageously isolates lateral, vertical, torsional and impact forces being imparted to the control apparatus 60 during operation of the doors 40 and 50 by either the conventional driver, used to move the doors between open and closed positions, or movements of the railcar during the unloading process. These and other advantageous ends, apparent to those skilled in the art, will be appreciated from the following disclosure.

Figure 12:
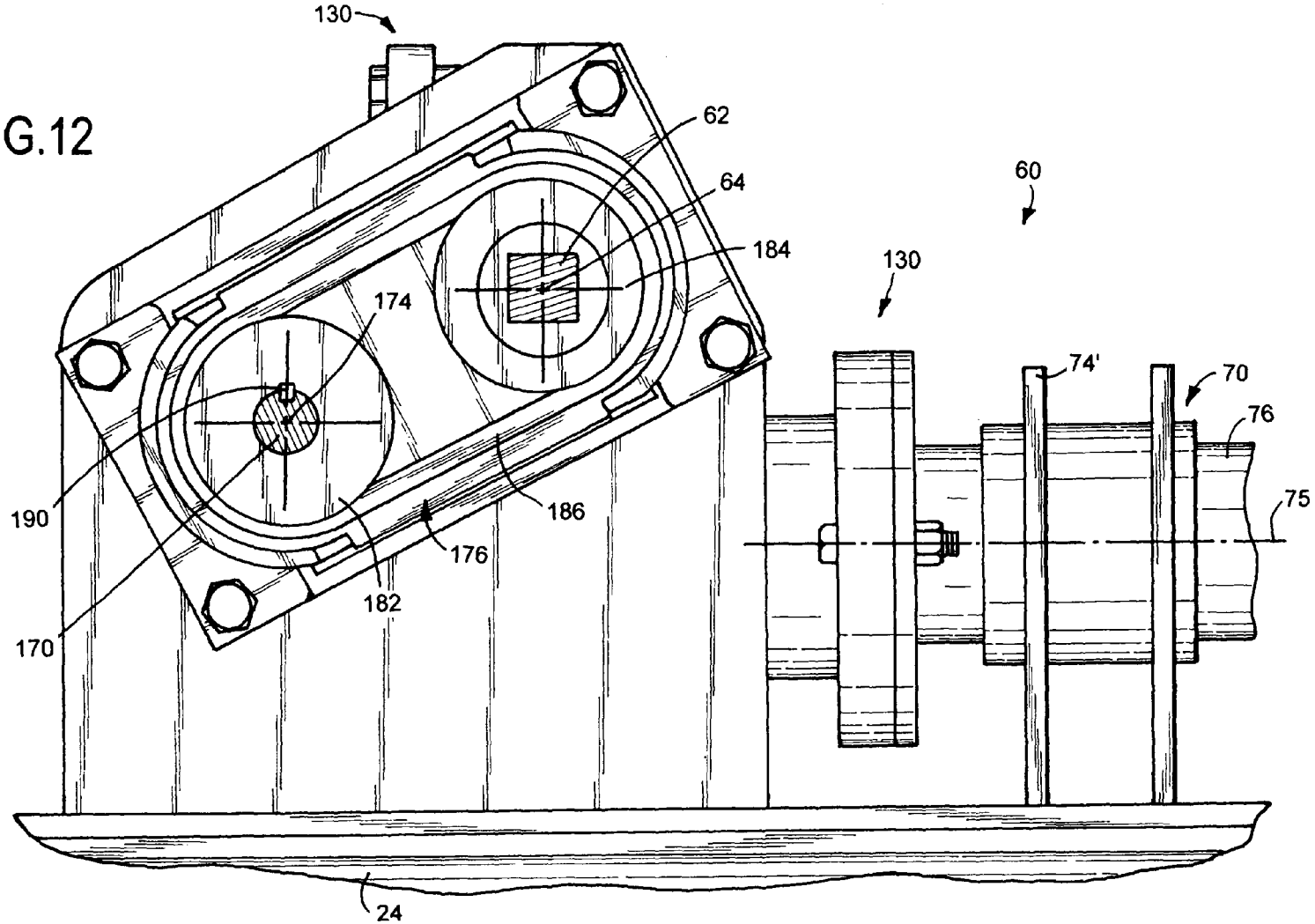
FIG. 12 is an enlarged view showing one form of a force transfer mechanism which can be used in combination with the present invention disclosure.

Turning to FIG. 12, input shaft 170 is operably and rotatably interconnected to the operating shaft 62 of the respective drive through a force transfer mechanism 176. In one embodiment, transfer mechanism 176 includes a drive member 182 carried by and rotatable with input shaft 170 and a driven member 184 carried by and rotatable with operating shaft 62. Notably, drive member 182 is non-rotatably mounted on input shaft 170. Similarly, driven member 184 is non-rotatably mounted on the operating shaft 62. As shown, the drive member 182 and driven member 184 are suitably interconnected to each other.

In the embodiment illustrated by way of example in FIG. 11, drive member 182 is preferably configured as a spur gear. Similarly, driven member 184 is preferably configured as a spur gear. Moreover, in the illustrated embodiment, drive member 182 and driven member 184 are interconnected preferably by means of a chain, belt or other suitable power transfer apparatus 186 entrained about and engagement with the drive and driven members 182 and 184, respectively. As such, when rotary motion is imparted to input shaft 170, rotary power from input shaft 170 is transferred by the force transfer mechanism 176 to operating shaft 62 whereby causing shaft 62 to rotate about axis 64.

As will be appreciated by those skilled in the art, any of several unexpected occurrences can inadvertently occur during operation of the hopper car. For example, as a result of rocks, and related debris becoming inadvertently entangled with ether drive 70, 70' the doors 40, 50 may be incapable of being moved under the influence of the continuously rotating conventional driver (not shown). Another example which could potentially cause damage to the control apparatus 60 can include a situation where the conventional driver continuously rotates after the doors 40, 50 are moved to either of their extreme positions thus exposing the control mechanism 60 to an excessive amount of torque being applied to the control apparatus 60 by the continuously rotating spindle of the conventional driver or the control limits on the conventional driver being set too high.

As such, drive transfer mechanism 176 furthermore preferably includes a shear pin 190 for protecting each drive 70, 70' and control apparatus 60 against inadvertent damage. Upon the happening of any one or more of the above-mentioned unexpected occurrences and others, the shear pin 190 will shear or otherwise break thereby separating the input shaft 172 from the control apparatus 60 so as to protect and isolate the control apparatus 60 against serious damages.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. An apparatus for controlling discharge of materials from a railcar having a wheeled frame defining a longitudinal axis for said car and a hopper carried on said frame, with said hopper defining a longitudinally disposed discharge opening, and with said railcar having a door mounted to said hopper for pivotal movement between an open position and a closed position relative to said discharge opening, said apparatus comprising:

an operating shaft carried by said car for rotation about a fixed axis;

a drive operably coupled between said door and said operating shaft for causing said door to move from the closed position toward the open position in response to rotation of said operating shaft in a first rotational direction, with said drive including a rotary lost motion connection for allowing said door to freely pivot toward the open position during collapsing movement of said lost motion connection and after said operating shaft has been rotated a predetermined amount to open said door, with said lost motion connection limiting the forces acting on said operating shaft as a result of the gravitational effects said materials have acting on the door as said door moves from the closed position toward an open position.

2. The apparatus according to claim 1 further including a bumper for cushioning impacts of said door against said frame when said door freely pivots toward the open position.

3. The apparatus according to claim 2 wherein said bumper includes elastomeric material.

4. The apparatus according to claim 1, wherein said drive includes a linkage assembly including first and second interconnected links positioned relative to each other, when said door is in the closed position, in an overcenter relationship whereby allowing said links to act as a primary lock for releasably maintaining said door in the closed position while preventing said door from inadvertently moving toward the open position.

5. The apparatus according to claim 4, wherein said drive further includes a gear box for transferring rotating movement of said operating shaft to said linkage system.

6. The apparatus according to claim 5, wherein said gear box includes a worm gear rotatable with said operating shaft and a driven gear arranged in operable combination with said worm gear, with said worm gear and said driven gear serving as a secondary lock for releasably maintaining said door in the closed position while preventing said door from inadvertently moving toward the open position.

7. The apparatus according to claim 1, wherein said rotary lost motion connection includes a slotted drive member which permits said drive to freely move through a predetermined range of movement relative to said operating shaft after said door begins to move toward the open position.

8. The apparatus according to claim 7, wherein the slotted drive member of said rotary lost motion connection includes radially spaced pin engagement surfaces.

9. The apparatus according to claim 8, wherein said rotary lost motion connection further includes a pin arranged for movement between the pin engagement of said slotted drive member for reconnecting said operating shaft with said drive upon the collapse of said rotary lost motion connection.

10. An apparatus for controlling discharge of materials from a railcar having a wheeled frame defining a longitudinal axis for said car and a hopper carried on said frame, with said hopper defining a longitudinally disposed discharge opening, and with said railcar having a door mounted to said hopper for pivotal movement between an open position and a closed position relative to said discharge opening, said apparatus comprising:

an operating shaft carried by said car for rotation about a fixed axis; and a drive operably coupled between said door and said operating shaft for causing said door to move from the closed position toward the open position in response to rotation of said operating shaft in a first rotational direction, with said drive including a driven shaft carried by said car in generally normal relation relative to said operating shaft, with said driven shaft being operably coupled to said operating shaft such that when said operating shaft is rotated said driven shaft rotates therewith, and with said drive further including a rotary lost motion connection between said door and said operating shaft for isolating said operating shaft during collapsing movement of said lost motion connection against the gravitational forces of material acting on said door as said door moves from the closed position toward the open position.

11. The apparatus according to claim 10 wherein said drive includes an apparatus operably disposed between said operating shaft and said door for inhibiting damage to said drive during operation of said door.

12. The apparatus according to claim 10 further including a bumper for cushioning impacts of said door against said frame when said door freely pivots toward the open position.

13. The apparatus according to claim 12 wherein said bumper includes elastomeric material.

14. The apparatus according to claim 10, wherein said drive includes a linkage assembly operated by said driven shaft, said linkage assembly including first and second interconnected links positioned relative to each other, when said door is in the closed position, in an overcenter relationship whereby allowing said links to act as a primary lock for releasably maintaining said door in the closed position while preventing said door from inadvertently moving toward the open position.

15. The apparatus according to claim 14, wherein said drive further includes a gear box for transferring rotating movement of said operating shaft to said linkage system.

16. The apparatus according to claim 15, wherein said gear box includes a worm gear rotatable with said operating shaft and a driven gear arranged in operable combination with said worm gear, with said worm gear and said driven gear serving as a secondary lock for releasably maintaining said door in the closed position while preventing said door from inadvertently moving toward the open position.

17. The apparatus according to claim 10, wherein said rotary lost motion connection includes a slotted drive member which permits said drive to freely move through a predetermined range of movement before said door begins to move toward the open position from the closed position.

18. The apparatus according to claim 17, wherein the slotted drive member of said rotary lost motion connection includes radially spaced pin engagement surfaces.

19. The apparatus according to claim 18, wherein said rotary lost motion connection further includes a pin carried by said driven shaft and arranged for movement between the pin engagement surfaces of said slotted drive member for reestablishing a connection between said operating shaft and said drive upon the collapse of said rotary lost motion connection.

20. The apparatus according to claim 10, further including an input shaft carried by said frame in generally parallel relationship relative to said operating shaft, with said input shaft and said operating shaft being operably interconnected through a force transfer mechanism.

21. An apparatus for controlling discharge of materials from a railcar having a wheeled frame defining a longitudinal axis for said car and a hopper carried on said frame, with said hopper defining a longitudinally disposed discharge opening, and with said railcar having two doors mounted to said hopper for pivotal movement between an open position and a closed position relative to said discharge opening, with a first door being mounted to one lateral side of the longitudinal axis of said car and with a second door being mounted to an opposed lateral side of the longitudinal axis of said car, said apparatus comprising:

an elongated operating shaft carried by said car for rotation about a fixed axis and which moves said doors simultaneously from the closed position toward and open position;

a first drive operably coupled between said first door and said operating shaft for causing said first door to move from the closed position toward the open position in response to rotation of said operating shaft in a first rotational direction, with said first drive including a lost motion connection for allowing said first door to freely pivot toward the open position during collapsing movement of said lost motion connection and after said operating shaft has been rotated a predetermined amount to open said first door, and with said lost motion connection isolating said operating shaft during collapsing movement of said lost motion connection against the gravitational forces of material acting on said first door as said first door toward the open position; and a second drive operably coupled between said second door and said operating shaft for causing said second door to move simultaneously with said first door from the closed position toward the open position in response to rotation of said operating shaft in said first rotational direction, with said second drive including a lost motion connection for allowing said second door to freely pivot toward the open position during collapsing movement of said lost motion connection and after said operating shaft has been rotated said predetermined amount to open said second door, and with said lost motion connection isolating said operating shaft during collapsing movement of said lost motion connection against the gravitational forces of material acting on said second door as said second door moves toward the open position.

22. The apparatus according to claim 21 wherein both said first drive and said second drive include an apparatus operably disposed between said operating shaft and said first and second doors for inhibiting damage to said first and second drives during operation of said doors.

23. The apparatus according to claim 21 wherein said first drive and said second drive each include a bumper for cushioning impacts of said first and second doors against said frame when said doors freely pivot toward their open position.

24. The apparatus according to claim 23 wherein each bumper includes elastomeric material.

25. The apparatus according to claim 21, wherein said first drive and said second drive each include a linkage assembly including first and second interconnected links positioned relative to each other, when the respective door is in the closed position, in an overcenter relationship whereby allowing said links to act as a primary lock for releasably maintaining the respective door in the closed position while preventing the respective door from inadvertently moving toward the open position.

26. The apparatus according to claim 25, wherein said first drive and said second drive each include a gear box for transferring rotary movement of said operating shaft to the linkage system of the respective drive.

27. The apparatus according to claim 26, wherein the gear box of each drive includes a worm gear rotatable with said operating shaft and a driven gear arranged in operable combination with said worm gear, with said worm gear and said driven gear serving as a secondary lock for releasably maintaining the respective door in the closed position while preventing the respective door from inadvertently moving toward the open position.

28. The apparatus according to claim 21, wherein the rotary lost motion connection of each drive includes a slotted drive member which permits each drive to freely move through a predetermined range of movement relative to said operating shaft after the respective door begins to move toward the open position.

29. The apparatus according to claim 28, wherein the slotted drive member of said rotary lost motion connection for each drive includes radially spaced pin engagement surfaces.

30. The apparatus according to claim 29, wherein said rotary lost motion connection of each drive further includes a pin arranged for movement between the pin engagement of said slotted drive member for reconnecting said operating shaft with each drive upon the collapse of the respective rotary lost motion connection.

31. The apparatus according to claim 21, wherein each drive includes a mechanical indicator for visually indicating the position of the respective door relative to the closed position.

* * * * *